US007726758B2

(12) United States Patent
Barkley et al.

(10) Patent No.: US 7,726,758 B2
(45) **Date of Patent: *Jun. 1, 2010**

(54) COMPOSITE PRINTHEAD FIRE SIGNALS

(75) Inventors: Lucas D. Barkley, Lexington, KY (US); David C. Stevenson, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/958,935

(22) Filed: Dec. 18, 2007

(65) Prior Publication Data

US 2008/0106559 A1 May 8, 2008

Related U.S. Application Data

(62) Division of application No. 10/736,183, filed on Dec. 15, 2003, now Pat. No. 7,350,888.

(51) Int. Cl.
*B41J 29/38* (2006.01)

(52) U.S. Cl. ..... 347/10; 347/11; 347/5

(58) Field of Classification Search ..... 347/14, 347/15, 17, 5, 9, 10, 11, 12
See application file for complete search history.

(56) References Cited

U.S. PATENT DOCUMENTS

| | | | | |
|---|---|---|---|---|
| 5,896,146 | A | 4/1999 | Murata et al. | |
| 5,907,331 | A | 5/1999 | Markham | |
| 5,936,644 | A | 8/1999 | Ono et al. | |
| 6,024,439 | A | 2/2000 | Sueoka et al. | |
| 6,276,776 | B1 | 8/2001 | Umezawa et al. | |
| 6,309,040 | B1 | 10/2001 | Norton | |
| 6,312,079 | B1 | 11/2001 | Anderson et al. | |
| 6,318,828 | B1 | 11/2001 | Barbour et al. | |
| 6,344,867 | B2 | 2/2002 | Inui | |
| 6,390,581 | B1 | 5/2002 | Lee et al. | |
| 6,439,697 | B1 | 8/2002 | Axtell et al. | |
| 6,447,092 | B1 | 9/2002 | Norton | |
| 6,520,613 | B1 | 2/2003 | Tamura | |
| 6,527,355 | B1 * | 3/2003 | Yang et al. | 347/14 |
| 6,540,333 | B2 | 4/2003 | Axtell et al. | |
| 6,543,882 | B2 | 4/2003 | Axtell et al. | |
| 6,578,943 | B2 | 6/2003 | Arquilevich et al. | |
| 6,585,339 | B2 | 7/2003 | Schloeman et al. | |
| 6,595,610 | B2 | 7/2003 | Norton | |
| 6,672,711 | B2 | 1/2004 | Kao et al. | |
| 7,350,888 | B2 * | 4/2008 | Barkley et al. | 347/5 |
| 2001/0045967 | A1 | 11/2001 | Hayasaki | |
| 2002/0089557 | A1 | 7/2002 | Schloeman et al. | |
| 2002/0093544 | A1 | 7/2002 | Schloeman et al. | |
| 2002/0113832 | A1 | 8/2002 | Kanematsu et al. | |
| 2002/0158928 | A1 | 10/2002 | Fujii | |
| 2003/0142157 | A1 | 7/2003 | Lee | |

FOREIGN PATENT DOCUMENTS

| | | |
|---|---|---|
| EP | 0674993 A2 | 6/1997 |
| EP | 1080901 A2 | 3/2001 |

* cited by examiner

*Primary Examiner*—Lam S Nguyen

(57) ABSTRACT

A method and device for providing a plurality of fire pulses in an ink jet printer, which includes a production of a plurality of fire signals. Each fire signal of the plurality of fire signals are asserted at a different timing than the other of the plurality of fire signals. The plurality of fire signals are combined to form a composite fire signal that maintains the different timing.

2 Claims, 11 Drawing Sheets

COMPOSITE PRINTHEAD FIRE SIGNALS

This is a Divisional of U.S. patent application Ser. No. 10/736,183, entitled "COMPOSITE PRINTHEAD FIRE SIGNALS", filed Dec. 15, 2003, issued U.S. Pat. No. 7,350, 888 on Apr. 1, 2008.

BACKGROUND OF THE INVENTION

1. Field of the Invention

The present invention relates to printhead fire signals in ink jet printers, and, more particularly, to composite printhead fire signals.

2. Description of the Related Art

A printhead in an ink jet printer can include an array of nozzles, and associated actuators, that expel ink onto a printing medium according to an image to be produced on the printing medium. Signals are provided to the printhead that control the actuators and nozzles, including fire signals that energize the actuators for a sequence of durations. The array of nozzles can be divided into two or more groups of nozzles that are addressed separately and driven by separate fire signals. The separate fire signals can each require an input to the printhead, and printhead input/output (I/O) are relatively expensive in ink jet printhead design and manufacturing.

What is needed in the art is a method and device that combines printhead fire signals while at the same time minimizes printhead I/O requirements.

SUMMARY OF THE INVENTION

The invention comprises, in one form thereof, a method and device for providing a plurality of fire pulses in an ink jet printer, which includes a production of a plurality of fire signals. Each fire signal of the plurality of fire signals is asserted at a different timing than an other of the plurality of fire signals. The plurality of fire signals are combined to form a composite fire signal that maintains the different timing.

In another form thereof, the invention is directed to an ink jet printer including a printhead carrier and a controller communicatively coupled to the printhead carrier for producing a plurality of fire signals. Each fire signal of the plurality of fire signals is asserted at a different timing than other of the plurality of fire signals. The controller combines the plurality of fire signals to form a composite fire signal that maintains the different timing.

In another form thereof, the invention is directed to a printhead cartridge for an ink jet printer including at least one ink reservoir and a printhead fluidly coupled to the at least one ink reservoir. The printhead includes a plurality of nozzles for ejecting ink, a plurality of actuators associated with the plurality of nozzles, an actuator firing logic circuit connected to the plurality of actuators for selectively energizing the plurality of actuators and a decoder circuit connected to the actuator firing logic circuit. The decoder circuit includes at least one input for receiving at least one composite fire signal.

In another form thereof, the invention is directed to a printhead for an ink jet printer including a plurality of nozzles for ejecting ink, a plurality of actuators associated with the plurality of nozzles, an actuator firing logic circuit connected to the plurality of actuators for selectively energizing the plurality of actuators and a decoder circuit connected to the actuator firing logic circuit. The decoder circuit includes at least one input for receiving at least one composite fire signal.

In yet another form thereof, the invention is directed to a method for providing a plurality of fire pulses in an ink jet printer including the step of producing a plurality of fire signals specific to a particular color. Each fire signal of the plurality of fire signals are asserted at a different timing than other of the plurality of fire signals.

An advantage of certain embodiments of the present invention can include a reduction in the number of inputs required in an ink jet printhead.

Another advantage can include a reduced cost of ink jet printheads due to the lower number of printhead inputs.

Yet another advantage might include the ability to make fire signals specific to a particular color and concurrently maintain the number of printhead inputs low.

A further advantage could include that other functionality requiring printhead I/O can be added to the printhead design due to the reduced printhead inputs required by the fire signals.

BRIEF DESCRIPTION OF THE DRAWINGS

The above-mentioned and other features and advantages, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention and such exemplifications are not to be construed as limiting the scope of the invention in any manner.

DETAILED DESCRIPTION OF THE INVENTION

Figure 1:
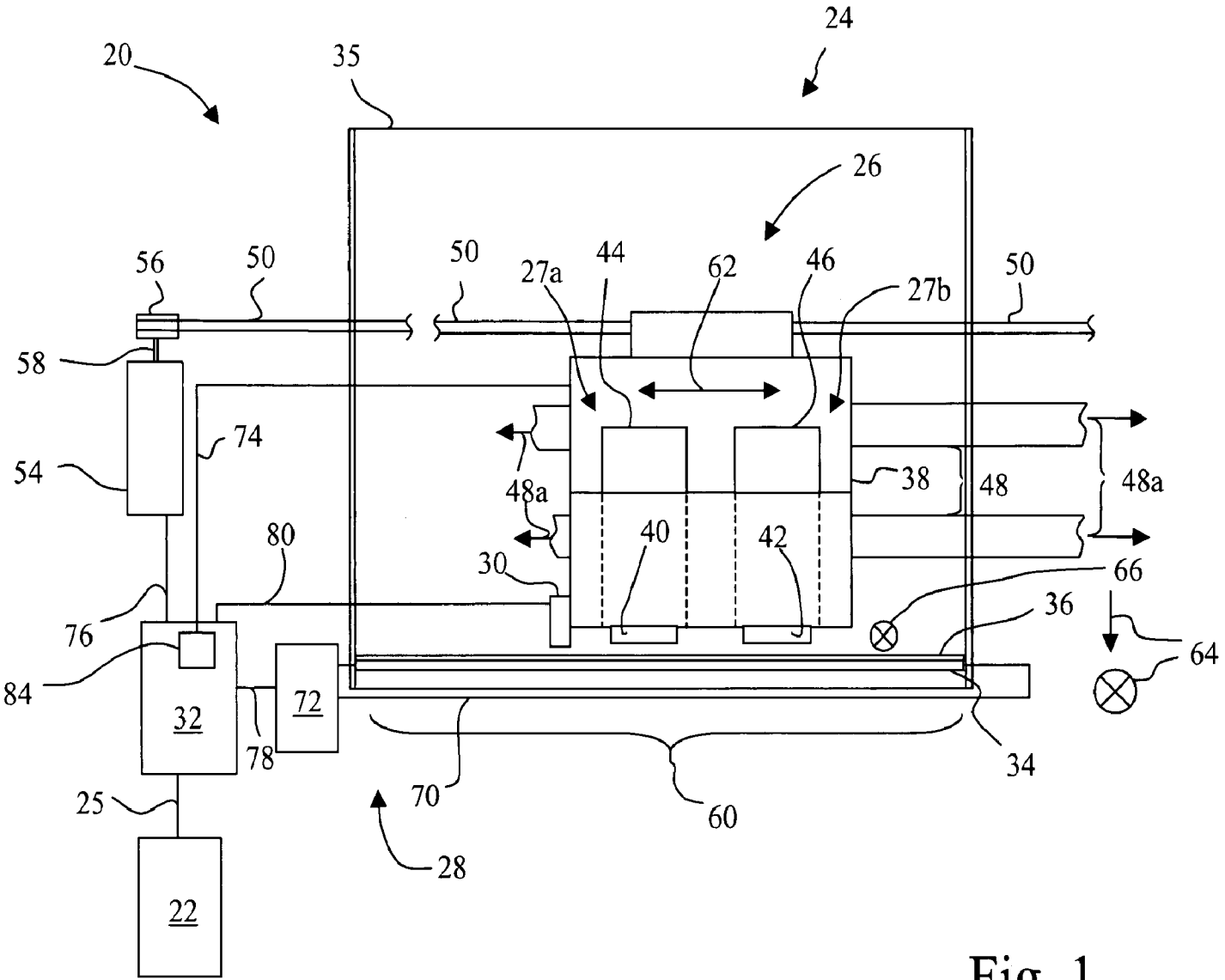
FIG. 1 is a diagrammatic representation of an embodiment of an imaging system incorporating the present invention.

Referring now to the drawings, and particularly to FIG. 1, there is shown an imaging system 20 embodying the present invention. Imaging system 20 includes a host 22 and an ink jet printer 24 as shown. Host 22 is communicatively coupled to ink jet printer 24 via a communications link 25. Communications link 25 may be, for example, a direct electrical or optical connection, or a network connection. Ink jet printer 24 includes ink jet printhead cartridges 27*a* and 27*b*, each of which include a supply ink.

Host 22 is typical of that known in the art, and includes a display, an input device, e.g., a keyboard or touchpad, a processor, and associated memory. Resident in the memory of host 22 is printer driver software. The printer driver software places print data and print commands in a format that can be recognized by ink jet printer 24.

Ink jet printer 24 includes a printhead carrier system 26, a feed roller unit 28, a media sensor 30, a controller 32, a mid-frame 34 and a media source 35.

Media source 35, such as a media tray, is configured to receive a plurality of print media sheets from which a print media sheet 36 is supplied to feed roller unit 28, which in turn further transports print media sheet 36 during a printing operation. Print media sheet 36 can be, for example, coated paper, plain paper, photo paper and transparency media.

Printhead carrier system 26 includes a printhead carrier 38 for carrying ink jet printhead cartridges 27*a*, 27*b*. As shown, ink jet printhead cartridge 27*a* may include a monochrome printhead 40 and/or a monochrome ink reservoir 44 provided in fluid communication with monochrome printhead 40. Ink jet printhead cartridge 27*b* may include a color printhead 42 and/or a color ink reservoir 46 provided in fluid communication with color printhead 42. Monochrome printhead 40 and monochrome ink reservoir 44 may be combined as an integral printhead cartridge, as shown, or remotely coupled via a fluid conduit. Likewise, color printhead 42 and color ink reservoir 46 may be combined as an integral printhead cartridge, as shown, or remotely coupled via a fluid conduit. Printhead carrier system 26 and printheads 40, 42 may be configured for unidirectional printing or bi-directional printing.

Mounted to printhead carrier 38 is media sensor 30. Media sensor 30 may be used to perform sensing functions, such as for example, printhead alignment and media sheet 36 type sensing.

Printhead carrier 38 is guided by a pair of guide members 48. Each of guide members 48 may be, for example, a guide rod or a guide rail. The axes 48*a* of guide members 48 define a bi-directional scanning path for printhead carrier 38, including media sensor 30, and thus, for convenience the bi-directional scanning path will be referred to as bi-directional scanning path 48*a*. Printhead carrier 38 is connected to a carrier transport belt 50 that is driven by a carrier motor 54 via carrier pulley 56. Carrier motor 54 has a rotating carrier motor shaft 58 that is attached to carrier pulley 56. At the directive of controller 32, printhead carrier 38 and media sensor 30 are transported in a reciprocating manner along guide members 48. Carrier motor 54 can be, for example, a direct current (DC) motor or a stepper motor.

The reciprocation of printhead carrier 38 transports ink jet printheads 40, 42 across the print media sheet 36, such as paper, along bi-directional scanning path 48*a* to define a two-dimensional, e.g., rectangular, print zone 60 of printer 24. This reciprocation occurs in a main scan direction 62. The print media sheet 36 is transported in a sheet feed direction 64. In the orientation of FIG. 1, the sheet feed direction 64 is shown as flowing down media source 35, and toward the reader (represented by an X) along mid-frame 34. Main scan direction 62, which is commonly referred to as the horizontal direction, is parallel with bi-directional scanning path 48*a* and is substantially perpendicular to sheet feed direction 64, which is commonly referred to as the vertical direction. During each printing or optical sensing scan of printhead carrier 38, the print media sheet 36 is held stationary by feed roller unit 28.

Mid-frame 34 provides support for the print media sheet 36 when the print media sheet 36 is in print zone 60, and in part, defines a portion of a print media path 66 of ink jet printer 24. Mid-frame 34 may include, for example, a plurality of horizontally spaced support ribs (not shown).

Feed roller unit 28 includes a feed roller 70 and corresponding pinch rollers (not shown). Feed roller 70 is driven by a drive unit 72 (FIG. 1). The pinch rollers apply a biasing force to hold the print media sheet 36 in contact with respective driven feed roller 70. Drive unit 72 includes a drive source, such as a stepper motor, and an associated drive mechanism, such as a gear train or belt/pulley arrangement. Feed roller unit 28 feeds the print media sheet 36 in the sheet feed direction 64.

Controller 32 is electrically connected and communicatively coupled to printheads 40 and 42 via a printhead interface cable 74. Controller 32 is electrically connected and communicatively coupled to carrier motor 54 via an interface cable 76. Controller 32 is electrically connected and communicatively coupled to drive unit 72 via an interface cable 78. Controller 32 is electrically connected and communicatively coupled to media sensor 30 via an interface cable 80.

Controller 32 includes a microprocessor having an associated random access memory (RAM) and read only memory (ROM). Controller 32 may be in the form of an application specific integrated circuit (ASIC).

Controller 32 executes program instructions to effect the printing of an image on the print media sheet 36. During printing, printhead carrier 38 is commanded to scan across print media sheet 36, and ink is ejected from one or both of printheads 40 and 42 to print a respective print swath. The term "print swath" is used to define a region traced by the corresponding printhead that extends across the width of the page in main scan (horizontal) direction 62 and extends in the sheet feed (vertical) direction 64 by a height corresponding to the length of the printhead nozzle array of the corresponding printhead. Following the completion of the printing of a print swath, controller 32 commands drive unit 72 to rotate feed roller 70 to advance print media sheet 36 by a predetermined amount in sheet feed direction 64, after which the next print swath is printed. This process repeats unit all print data to be printed on print media sheet 36 is printed.

Figure 2:
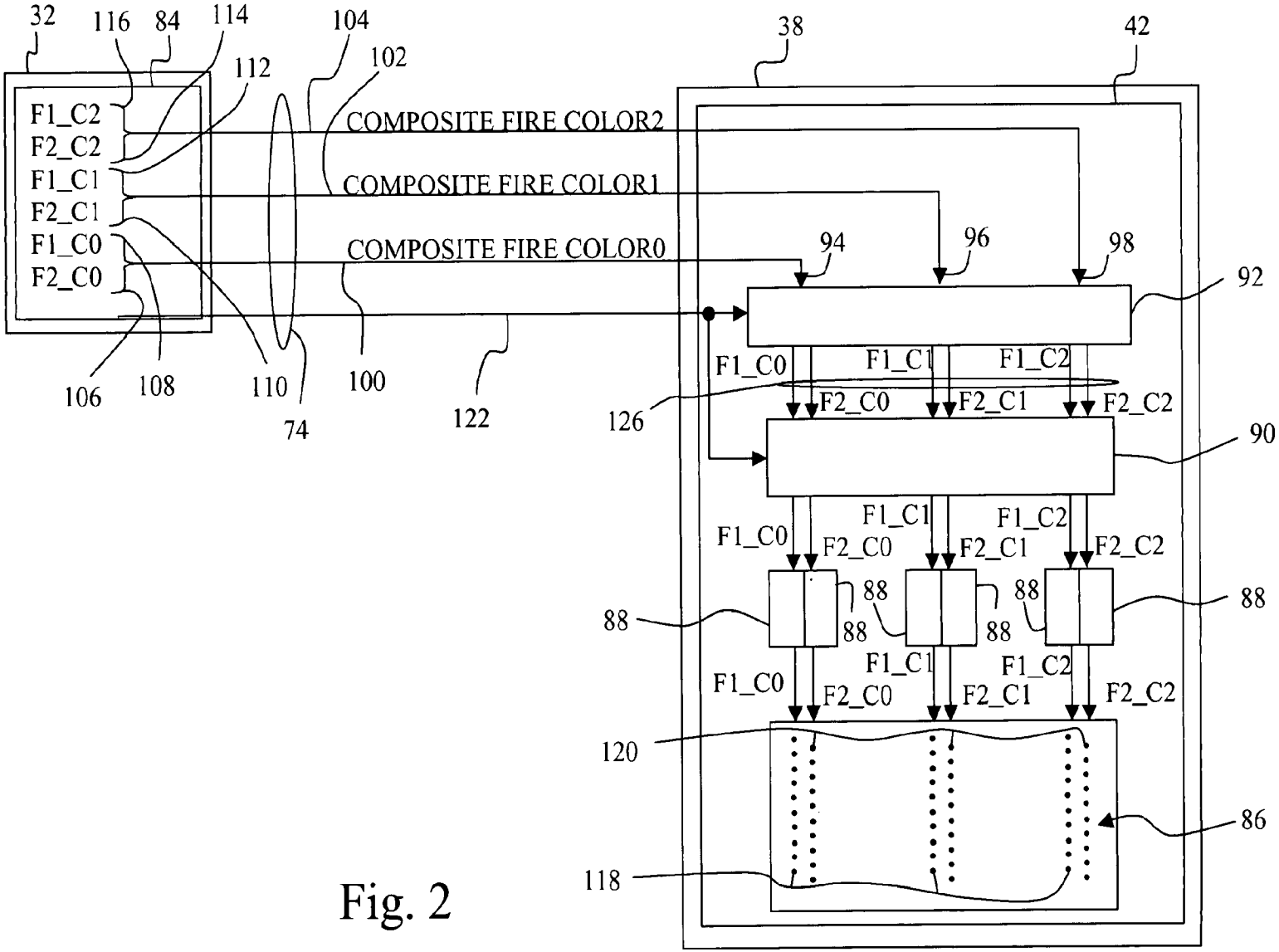
FIG. 2 is a diagrammatic representation in a simplified block diagram form showing a controller electrically coupled to a printhead formed integral with a printhead cartridge, of the imaging system of FIG. 1.

FIG. 2 is a simplified block diagram showing controller 32 electrically coupled to color printhead 42 via printhead interface cable 74. Controller 32 includes composite fire generator 84. Composite fire generator 84 can include circuitry and/or firmware (or other stored instructions) within controller 32, an ASIC or single state machine or some combination thereof.

Printhead 42 can include a plurality of nozzles 86, depicted as circles, for ejecting ink. Each of a plurality of individually selectable actuators 88 is respectively associated with one of nozzles 86, and six exemplary actuators 88 are shown in FIG. 2 in block diagram form. Actuators 88 can be, for example, a resistive heater element or a piezoelectric element. An actuator firing logic circuit 90, shown in FIG. 2 in block diagram form, is connected to actuators 88 for selectively energizing actuators 88. A decoder circuit 92 is connected to actuator firing logic circuit 90. Decoder circuit 92 includes, for example inputs 94, 96, 98 for receiving respective composite fire signals 100, 102, 104.

Composite fire generator 84 produces a plurality of fire signals 106, 108, 110, 112, 114, 116, individually labeled F2_C0, F1_C0, F2_C1, F1_C1, F2_C2, and F1_C2, respectively. The terms "F1" and "F2" refer to first and second fire signals, i.e., FIRE1 and FIRE2, respectively. The terms "C0", "C1", and "C2" refer to three colors (e.g., cyan, magenta and yellow) used in color printing, wherein, for example, "C0" corresponds to a first color (i.e., COLOR0), "C1" corresponds to a second color (i.e., COLOR1), and "C2" corresponds to a third color (i.e., COLOR2). The signal name of F1_C2, for example, signifies FIRE1 for COLOR2.

Composite fire generator 84 combines fire signals 106, 108 (F2_C0, F1_C0) to produce composite fire signal 100 (COMPOSITE FIRE COLOR0). Composite fire generator 84 combines fire signals 110, 112 (F2_C1, F1_C1) to produce composite fire signal 102 (COMPOSITE FIRE COLOR1). Composite fire generator 84 combines fire signals 114, 116 (F2_C2, F1_C2) to produce composite fire signal 104 (COMPOSITE FIRE COLOR2).

Examples of fire signal timing for an arbitrary color are given in FIGS. 3-6. In each of FIGS. 3-6 the solid lines represent a pulse waveform and the dashed lines interrelate the pulse waveforms in time. The horizontal component of each waveform represents time with wider (horizontally) pulses indicating a longer (in time) duration relative to a narrower pulse. The vertical component of each waveform represents a magnitude of the pulse, such as a voltage, current and/or energy value.

Fire signals 106, 108, 110, 112, 114, 116 can include a prefire pulse PRE1, for example, and a mainfire pulse MAIN1, each having a width according to the desired energy to be delivered to an associated actuator. The prefire pulse is typically used to warm the printhead and the mainfire pulse fires ink from the nozzles. Both prefire pulse widths and mainfire pulse widths can be varied as a function of printhead temperature to maintain a constant drop mass and size of the expelled ink thereby ensuring consistent image quality. A prefire pulse width is typically less than a mainfire pulse width and the prefire pulse width can be reduced to zero.

Referring again to FIG. 2, nozzles 86, and associated actuators 88, can be separated into individually addressable groups. Each group of nozzles and actuators can be further divided into two fire groups, such as, for example, FIRE1 fire group 118 and FIRE2 fire group 120. The three arrays of nozzles at 86 can be associated with, for example, cyan, magenta and yellow inks respectively. In such an example there is at least one first fire signal (F1_C0, F1_C1 and F1_C2) associated with FIRE1 fire group 118 and at least one second fire signal (F2_C0, F2_C1 and F2_C2) associated with FIRE2 fire group 120.

As shown in each of FIGS. 3-6, fire signal FIRE1 is not asserted at the same timing as fire signal FIRE2 signal in order to limit peak printhead current. Each of FIGS. 3-6 depict two embodiments to facilitate the combination of fire signals FIRE1 and FIRE2 into a composite fire signal that maintains the different timing of fire signals FIRE1 and FIRE2.

Figure 3:
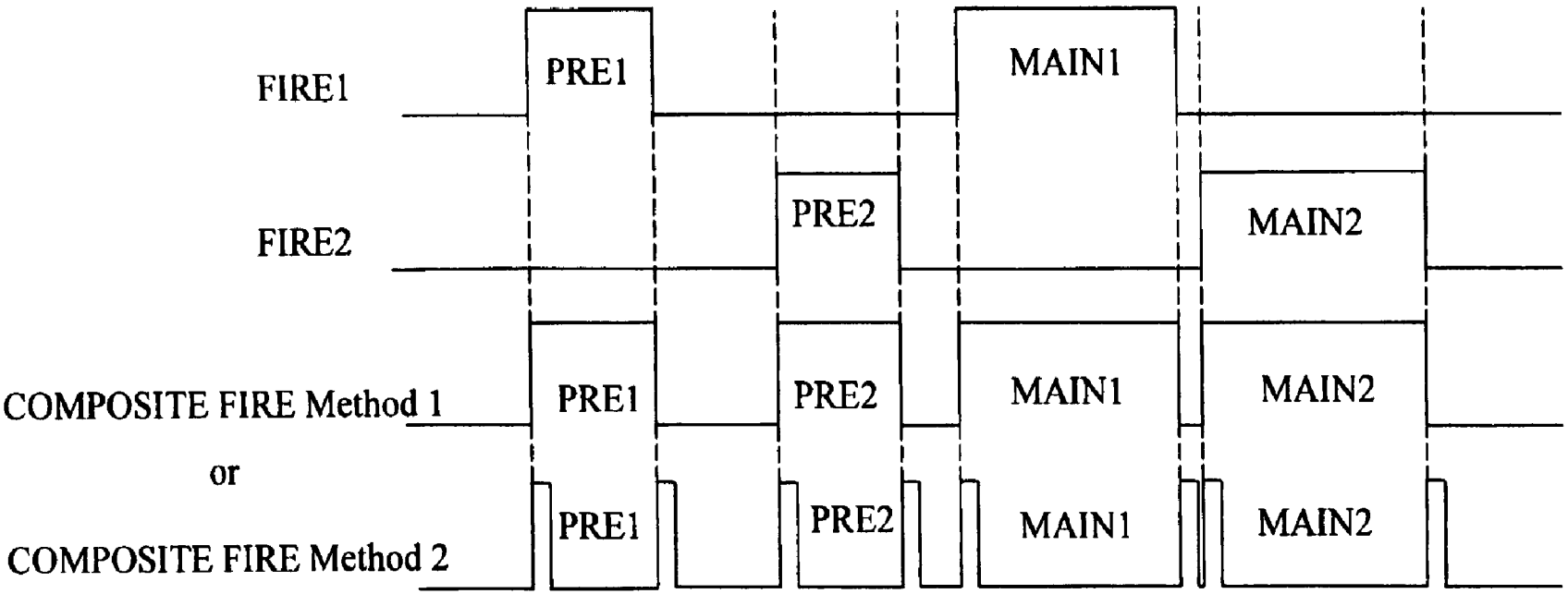
FIG. 3 is a timing diagram for embodiments of the present invention with forward address interlaced timing of the composite printhead fire signals.

FIG. 3 shows two embodiments of composite fire methods for forward address interlaced timing of fire signals FIRE1 and FIRE2. Forward address applies when the PRE1 pulse of fire signal FIRE1 proceeds the PRE2 pulse of fire signal FIRE2, for example, as can be the case in a forward scan direction for bi-directional printing. Interlaced timing in these embodiments has the PRE2 pulse of fire signal FIRE2 inserted between the PRE1 and MAIN1 pulses of fire signal FIRE1, and the MAIN2 pulse of fire signal FIRE2 following the MAIN1 pulse of fire signal FIRE1. The forward address interlaced timing of FIG. 3 can further be COMPOSITE FIRE Method 1 or COMPOSITE FIRE Method 2 where COMPOSITE FIRE Method 1 maintains the prefire and mainfire pulse widths whereas COMPOSITE FIRE Method 2 constructs the prefire and mainfire pulse widths with two respective short pulses at the leading and falling edges of each of the original pulses.

Figure 4:
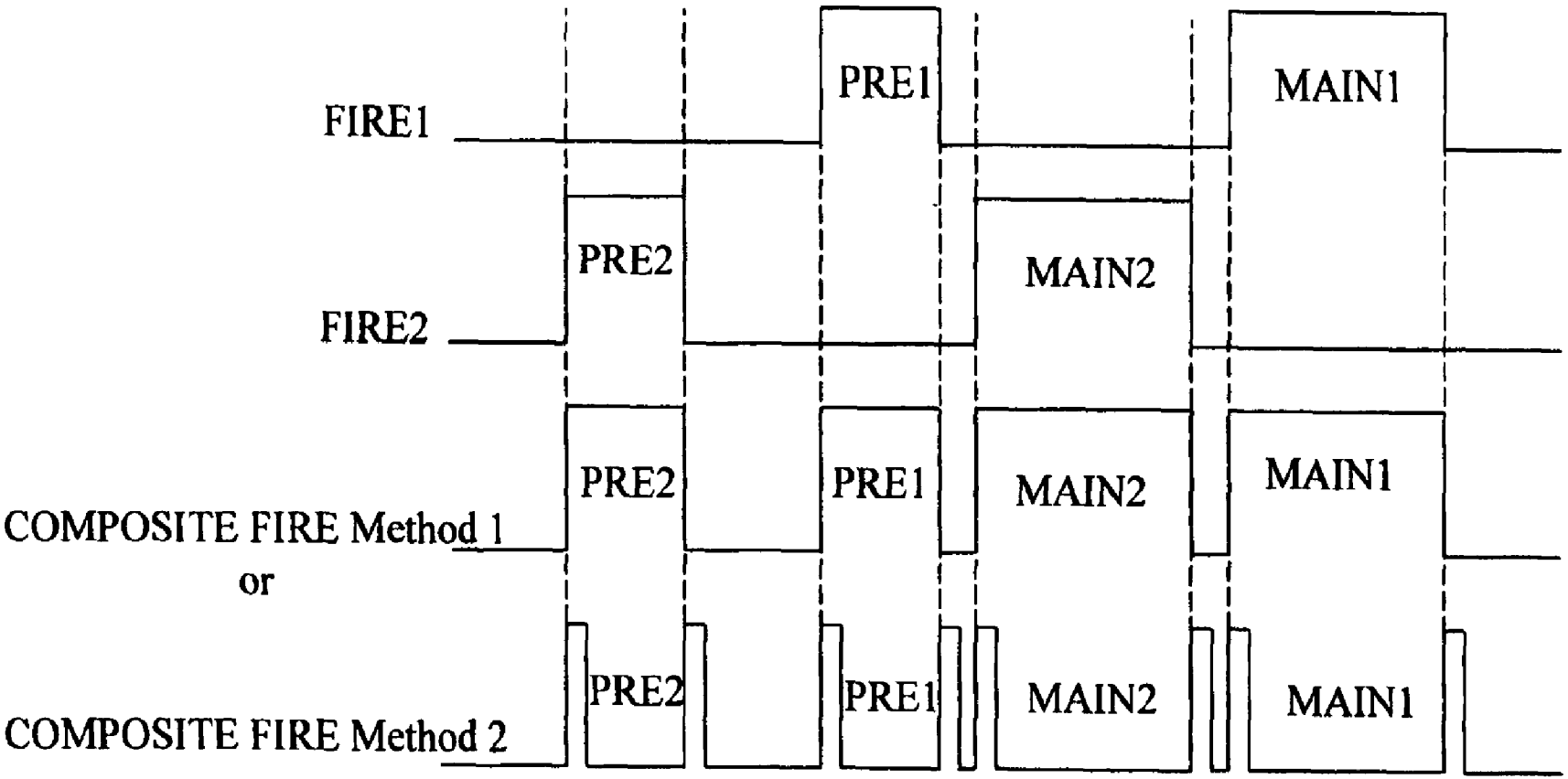
FIG. 4 is a timing diagram for embodiments of the present invention with reverse address interlaced timing of the composite printhead fire signals.

FIG. 4 shows two embodiments of composite fire methods for reverse address interlaced timing of fire signals FIRE1 and FIRE2. Reverse address applies when the PRE2 pulse of fire signal FIRE2 proceeds the PRE1 pulse of fire signal FIRE1, for example, as can be the case in a reverse scan direction for bi-directional printing. Interlaced timing in these embodiments has the PRE1 pulse of fire signal FIRE1 inserted between the PRE2 and MAIN2 pulses of fire signal FIRE2, and the MAIN1 pulse of fire signal FIRE1 following the MAIN2 pulse of fire signal FIRE2. The reverse address interlaced timing of FIG. 4 can further be COMPOSITE FIRE Method 1 or COMPOSITE FIRE Method 2 where COMPOSITE FIRE Method 1 maintains the prefire and mainfire pulse widths whereas COMPOSITE FIRE Method 2 constructs the prefire and mainfire pulse widths with two respective short pulses at the leading and falling edges of each of the original pulses.

Figure 5:
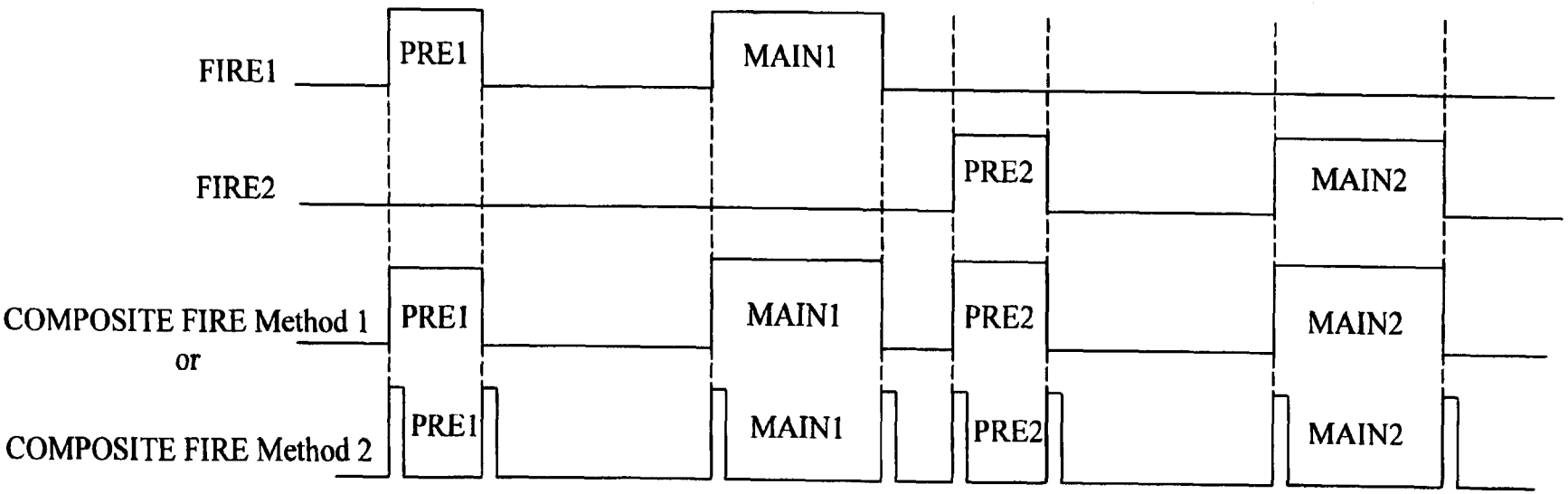
FIG. 5 is a timing diagram for embodiments of the present invention with forward address non-interlaced timing of the composite printhead fire signals.

FIG. 5 shows two embodiments of composite fire methods for forward address non-interlaced timing of fire signals FIRE1 and FIRE2. Forward address applies when the PRE1 pulse of fire signal FIRE1 proceeds the PRE2 pulse of fire signal FIRE2, for example, as can be the case in a forward scan direction for bi-directional printing. Non-interlaced timing in these embodiments has both of the PRE1 and MAIN1 pulses of fire signal FIRE1 preceeding the PRE2 and MAIN2 pulses of fire signal FIRE2. The forward address non-interlaced timing of FIG. 5 can further be COMPOSITE FIRE Method 1 or COMPOSITE FIRE Method 2 where COMPOSITE FIRE Method 1 maintains the prefire and mainfire pulse widths whereas COMPOSITE FIRE Method 2 constructs the prefire and mainfire pulse widths with two respective short pulses at the leading and falling edges of each of the original pulses.

Figure 6:
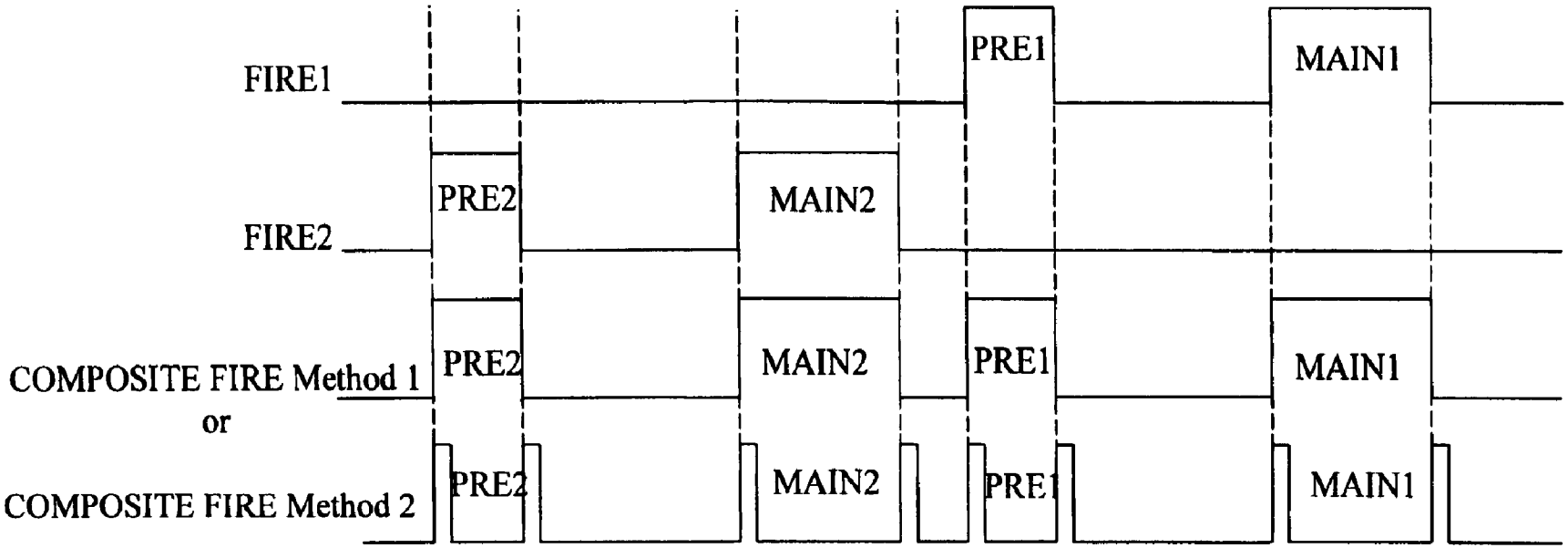
FIG. 6 is a timing diagram for embodiments of the present invention with reverse address non-interlaced timing of the composite printhead fire signals.

FIG. 6 shows two embodiments of composite fire methods for reverse address non-interlaced timing of fire signals FIRE1 and FIRE2. Reverse address applies when the PRE2 pulse of fire signal FIRE2 precedes the PRE1 pulse of fire signal FIRE1, for example, as can be the case in a reverse scan direction for bi-directional printing. Non-interlaced timing in these embodiments has both of the PRE2 and MAIN2 pulses of fire signal FIRE2 preceeding the PRE1 and MAIN1 pulses of fire signal FIRE1. The reverse address non-interlaced timing of FIG. 6 can further be COMPOSITE FIRE Method 1 or COMPOSITE FIRE Method 2 where COMPOSITE FIRE Method 1 maintains the prefire and mainfire pulse widths whereas COMPOSITE FIRE Method 2 constructs the prefire and mainfire pulse widths with two respective short pulses at the leading and falling edges of each of the original pulses.

In the eight composite fire methods of FIGS. 3-6, the original signal timing of each of the fire signals FIRE1 and FIRE2 are maintained.

Figure 7:
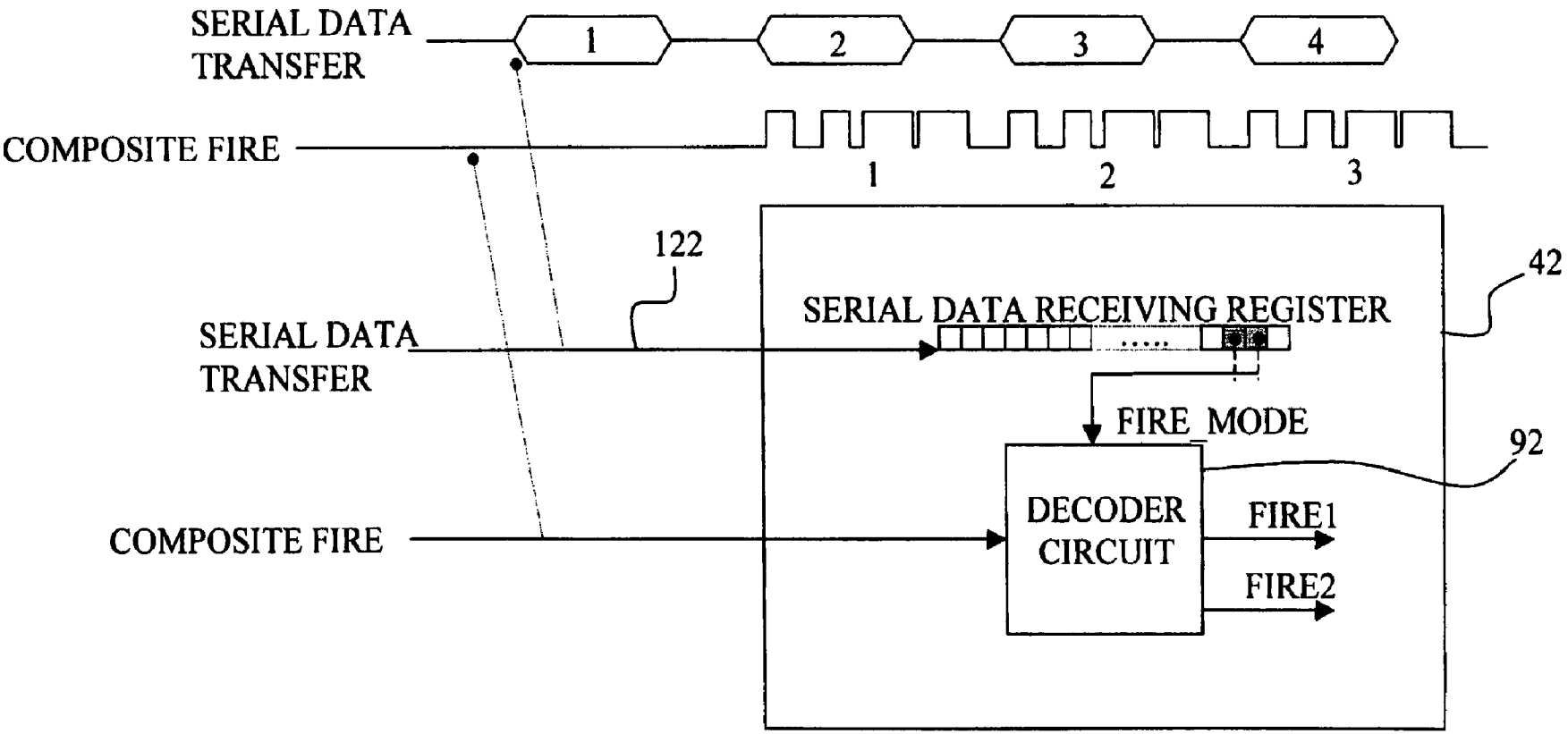
FIG. 7 is a diagrammatic representation in a simplified block diagram form showing an embodiment of a decoder circuit receiving a fire mode and a composite printhead fire signal of the present invention.

Referring now to FIGS. 2 and 7, signals on signal line 122, which may include multiple conductors, can include fire mode (forward, reverse, interlaced, non-interlaced), primitive (print data) and address information. Address information can be used by actuator firing logic circuit 90 to address groups of nozzles 86. Primitive information (print data) can be used by actuator firing logic circuit 90 to provide print data to addressed nozzles 86.

FIG. 7 illustrates how fire mode data from signal line 122 can be used by decoder circuit 92 to identify one of the four main composite fire methods (forward, reverse, interlaced, non-interlaced) of FIGS. 3-6. FIG. 7 shows the transfer of nozzle print and addressing (SERIAL DATA TRANSFER 1, 2, 3, 4) data with FIRE_MODE embedded in this information, followed by its respective FIRE information. Three full transfer and fire transactions are shown. In this example, FIRE_MODE is shown as 2 bits of information which is sufficient to represent the four possible timing sequences (forward interlaced, reverse interlaced, forward non-interlaced, reversed non-interlaced) from FIGS. 3-6. However, this can be any number of bits representing a larger number of possible sequences.

Figure 8:
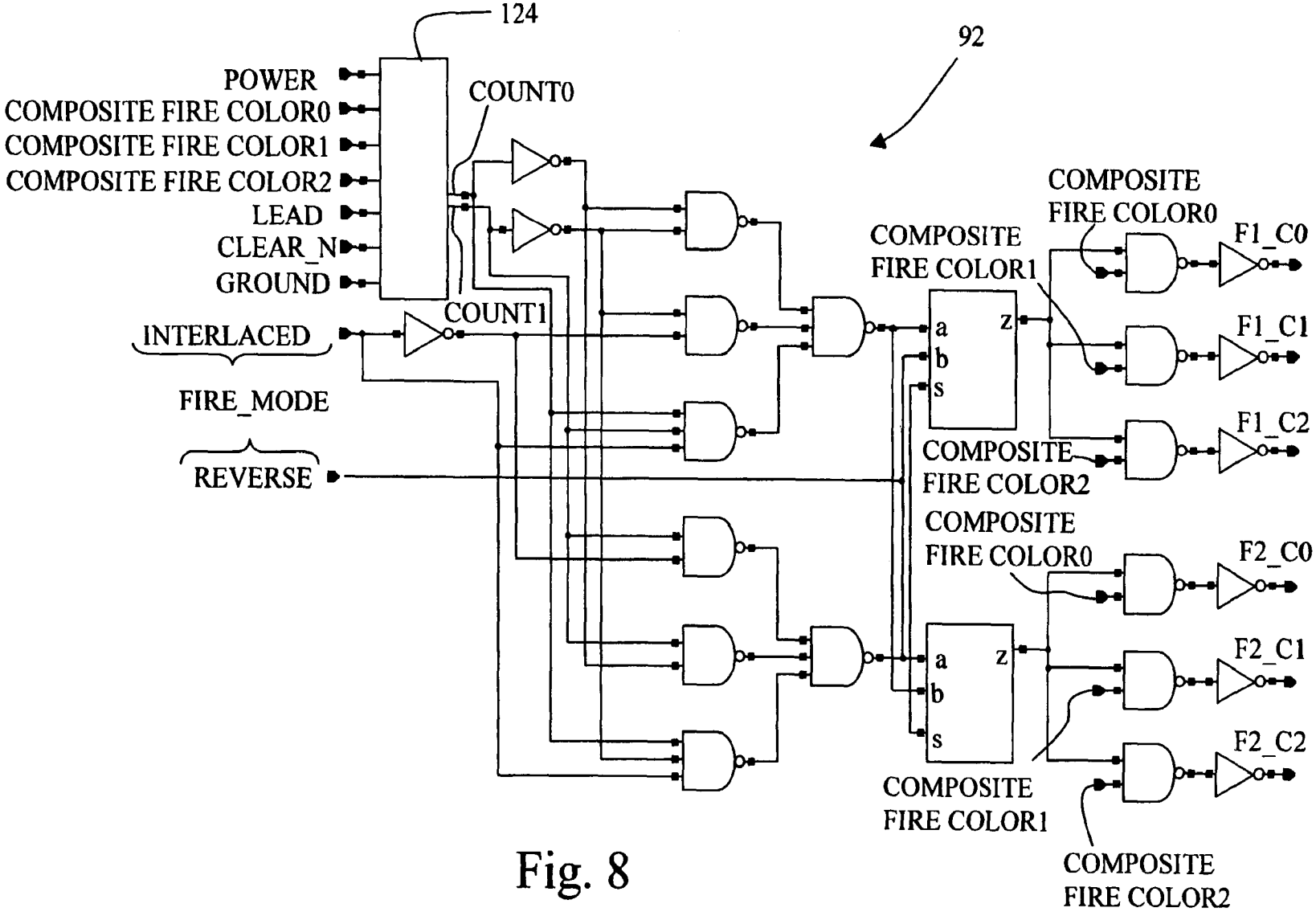
FIG. 8 is a circuit schematic for an embodiment of a decoder circuit of the present invention.
Figure 9:
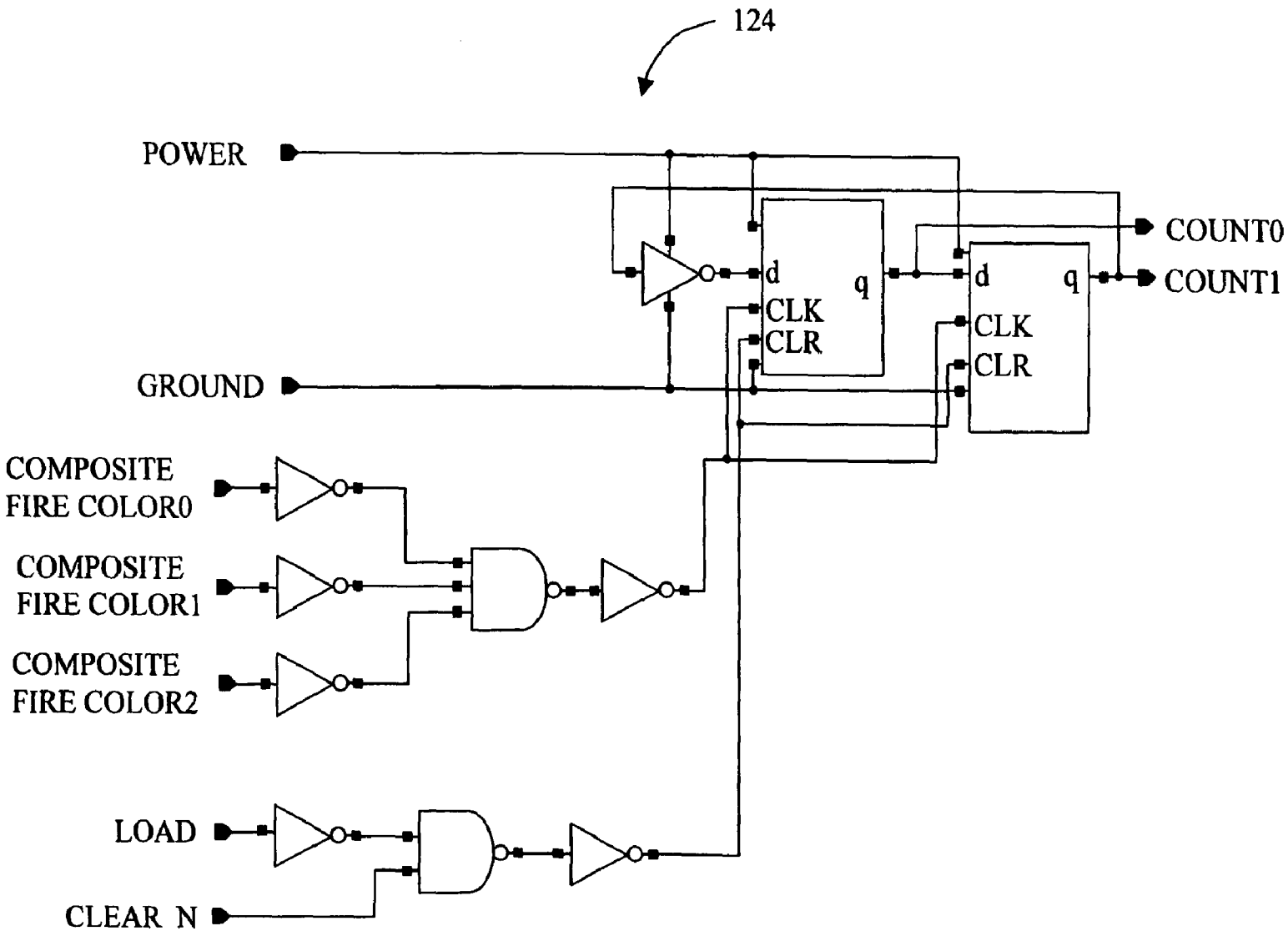
FIG. 9 is a circuit schematic for an embodiment of a composite fire state counter of the present invention.

An embodiment of decoder circuit 92 is shown in FIG. 8. An embodiment of composite fire state counter 124 of decoder circuit 92 is shown in FIG. 9. Composite fire signals COMPOSITE FIRE COLOR0 through COLOR2 are decoded into decoded fire signals F1_C0 through F2_C2 as shown in detail in FIG. 8. Decoded fire signals F1_C0 through F2_C2 can be used to energize actuators 88 (see FIG. 2) using actuator fire signals 126. While the decoder circuit 92, shown in FIG. 8, is designed to decode multiple composite fire signals it is contemplated that a separate decoder circuit may be provided to decode each composite fire signal, without departing from the spirit of the present invention.

Composite fire state counter 124, for example, is a 2 bit counter and whenever all three input composite fire signals (COMPOSITE FIRE COLOR0 through COLOR2) are inactive the counter increments so that composite fire state counter 124 is incremented and stable before the composite fire signals become active again and to prevent a race condition since the state bits are "ANDED" with the input composite fire signals. Counter 124 is cleared by either a LOAD pulse, which occurs between each FIRE period, or the CLEAR_N signal.

The six individual fire signals (F1_C0 through F2_C2) outputted by decoder circuit 92 are derived from the three input composite fire signals and composite fire state counter 124. The outputs of composite fire state counter 124 are decoded into six internal fire signals. Additional inputs to decoder circuit 92 are FIRE_MODE signals INTERLACED and REVERSE. For example, COMPOSITE FIRE COLOR0 is decoded in time into two separate signals, F1_C0 and F2_C0. If REVERSE is inactive then the F1_C0 occurs before F2_C0. If REVERSE is active than F2_C0 occurs before F1_C0. If INTERLACED is active then the signals can be interlaced as shown in FIGS. 3 and 4, for example.

Fire signals 106, 108, 110, 112, 114, 116 can be produced such that they are specific to a particular color. For example, fire signals 106, 108 (F2_C0, F1_C0) can be produced for the cyan color; fire signals 110, 112 (F2_C1, F1_C1) can be produced for the magenta color; and fire signals 114, 116 (F2_C2, F1_C2) can be produced for the yellow color. An advantage of such an arrangement might include that fire signal pulse width (such as the prefire and mainfire pulses in FIGS. 3-6) variation can be made for an individual color. Different color inks have different formulations, fluid dynamics and thermodynamics. Due to such variation among different color inks, in addition to variation in color use due to the image to be produced, varying prefire and mainfire pulse widths can optimize constant drop mass and size for each color, thereby ensuring consistent image quality.

Expansion of the number of fire signals to include fire signal color discrimination has the potential disadvantage of increasing printhead input/output (I/O) signals, which is relatively expensive in ink jet printhead design and manufacturing, and was heretofore prohibited given the competitive pricing of ink jet printers. However, the expanded number of fire signals for individual colors can be reduced by the composite fire method of certain embodiments of the present invention, thereby improving ink jet printhead performance while maintaining cost objectives.

Figure 10:
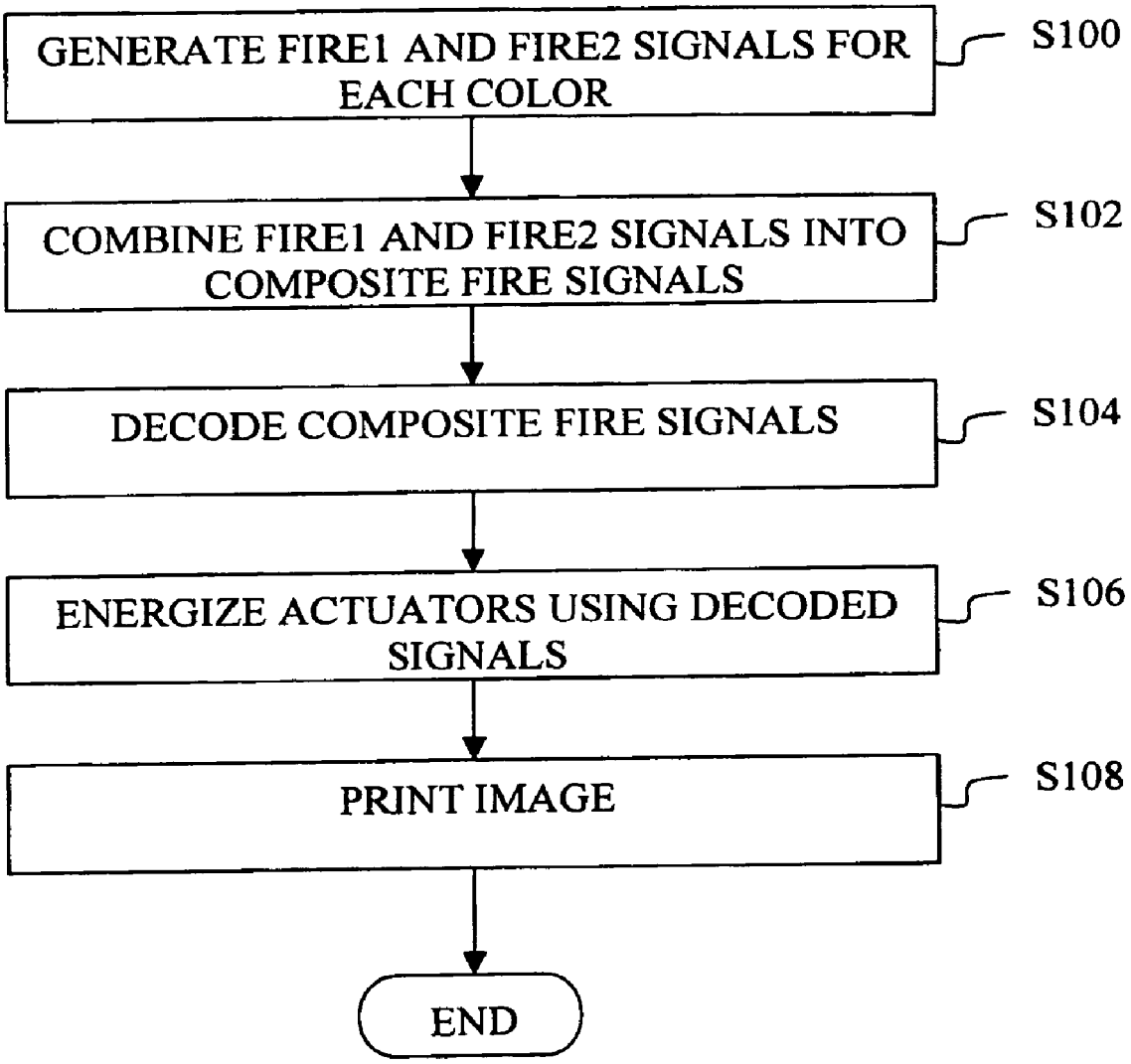
FIG. 10 is a general flowchart of an embodiment of a composite printhead fire method in accordance with the present invention.

FIG. 10 shows a flowchart for a process for practicing one embodiment of the present invention in conjunction with the circuitry and timing diagrams described above and in FIGS. 1-9. In step S100, fire signals FIRE1 and FIRE2 are generated for each respective color. Fire signals FIRE1 (F1_C0, F1_C1, F1_C2) and FIRE2 (F2_C0, F2_C1, F2_C2) are generated, for example, in composite fire generator 84 of FIG. 2. Each fire signal can have a waveform, for example, as shown by the FIRE1 and FIRE2 waveforms of FIGS. 3-6.

In step S102, fire signals FIRE1 and FIRE2 are combined to form composite fire signals. Fire signals FIRE1 (F1_C0, F1_C1, F1_C2) and FIRE2 (F2_C0, F2_C1, F2_C2) are combined, for example, in composite fire generator 84 to form composite fire signals COMPOSITE FIRE COLOR0 (F1_C0+F2_C0), COMPOSITE FIRE COLOR1 (F1_C1+F2_C1) and COMPOSITE FIRE COLOR2 (F1_C2+F2_C2). Each composite fire signal can have a waveform, for example, as shown by the COMPOSITE FIRE Method 1 and COMPOSITE FIRE Method 2 waveforms of FIGS. 3-6.

In step S104, the composite fire signals are decoded. Composite fire signals COMPOSITE FIRE COLOR0 (F1_C0+F2_C0), COMPOSITE FIRE COLOR1 (F1_C1+F2_C1) and COMPOSITE FIRE COLOR2 (F1_C2+F2_C2) are decoded by decoder circuit 92, for example, into fire signals F1_C0, F2_C0, F1_C1, F2_C1, F1_C2 and F2_C2, respectively.

In step S106, actuators are energized using the decoded fire signals. Actuators 88 are energized, for example, using decoded fire signals F1_C0, F2_C0, F1_C1, F2_C1, F1_C2 and F2_C2.

In step S108, an image or image segment is printed. The energized actuators 88 in step S106 causes nozzles 86 to expel ink resulting in the printing of an image or image segment.

Figure 11:
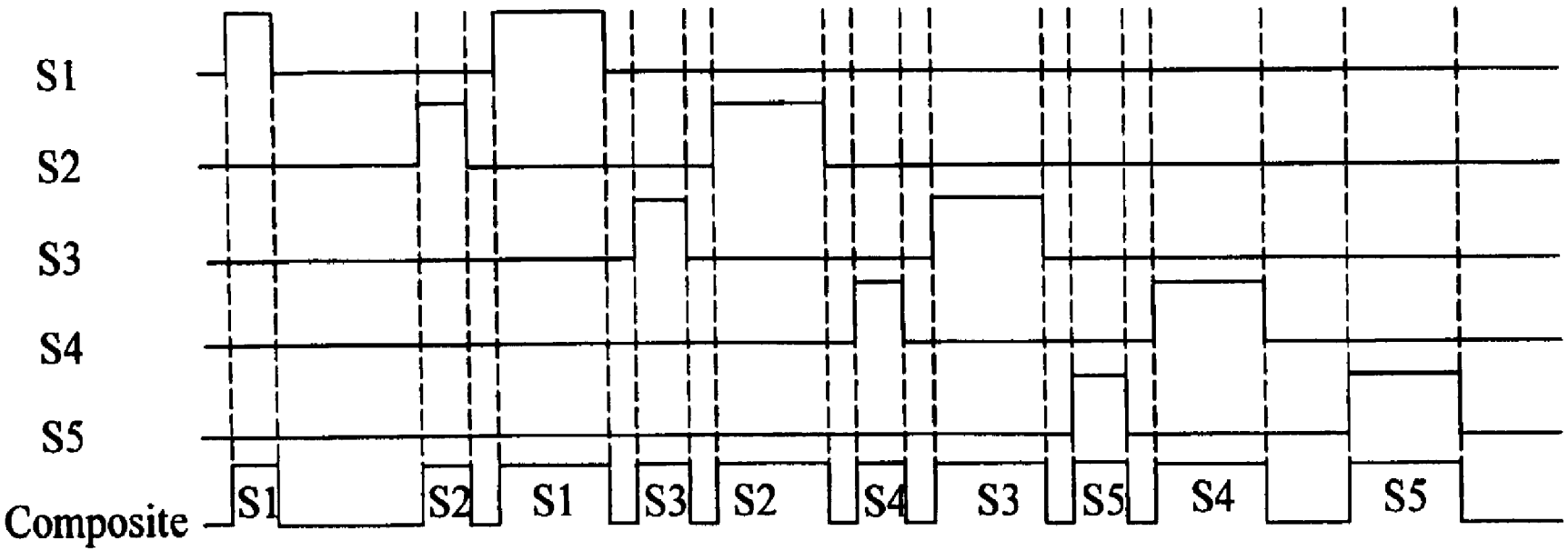
FIG. 11 is a timing diagram for an embodiment of a composite printhead fire signal having five component fire signals.

The composite fire method can be expanded into any number of signals that are asserted at a different timing. FIG. 11 illustrates an embodiment of five signals S1-S5 all of which are asserted at a different timing. As with FIGS. 3-6, in FIG. 11 the solid lines represent a pulse waveform and the dashed lines interrelate the pulse waveforms in time. The horizontal component of each waveform represents time with wider (horizontally) pulses indicating a longer (in time) duration relative to a narrower pulse. The vertical component of each waveform represents a magnitude of the pulse, such as a voltage, current and/or energy value.

As can be understood by one skilled in the art, the composite printhead fire signals can also be used in monochrome printhead 40. Monochrome printhead 40 can have a group of nozzles with two arrays, one with a fire signal FIRE1 and the second array with a fire signal FIRE2 which are not asserted at the same time to limit the peak current in monochrome printhead 40. The monochrome printhead 40 fire signals FIRE1 and FIRE2 can be combined and decoded in a manner similar to the color fire signals described above to reduce the monochrome printhead 40 fire signal inputs from two to one, for example.

While this invention has been described with respect to embodiments of the invention, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method for providing a plurality of fire pulses in an ink jet printer, comprising:

producing a plurality of fire signals, each fire signal of said plurality of fire signals being asserted at a different timing than other of said plurality of fire signals; and combining said plurality of fire signals to form a single composite fire signal that maintains said different timing, wherein each of said plurality of fire signals includes a prefire signal and mainfire signal, the prefire signal and the mainfire signal having varying widths; and wherein further said step of combining comprises constructing the prefire and the mainfire signal widths with two respective pulses at leading and falling edges of each of the prefire and mainfire signal.

2. A method for providing a plurality of fire pulses in an inkjet printer, comprising:

producing a plurality of fire signals, each fire signal of said plurality of fire signals being asserted as a different timing that other of said plurality of fire signals; and combining said plurality of fire signals to form a single composite fire signal that maintains said different timing, wherein each of said plurality of fire signals includes a prefire signal and a mainfire signal, the prefire signal and the mainfire signal having varying widths and wherein said step of combining comprises constructing the prefire and mainfire signal widths with two respective pulses at leading and falling edges of each of the pre fire and mainfire signal.

* * * * *